United States Patent [19]

Sawtelle

[11] Patent Number: 4,481,933

[45] Date of Patent: Nov. 13, 1984

[54] FIRE EXTINGUISHING ATTACHMENT FOR CHIMNEY STACKS

[76] Inventor: Kenneth Sawtelle, Hemlock Dr. (Box 39), Fitzwilliam, N.H. 03447

[21] Appl. No.: 508,850

[22] Filed: Jun. 29, 1983

[51] Int. Cl.[3] ..... A62C 31/00

[52] U.S. Cl. ..... 126/58; 126/314; 169/51; 169/54

[58] Field of Search ..... 126/58, 314, 316, 315, 126/313, 80, 52; 169/51, 54; 239/282

[56] References Cited

U.S. PATENT DOCUMENTS

| | | | |
|---|---|---|---|
| 656,895 | 8/1900 | King | 126/293 |
| 891,900 | 6/1908 | Belvin | 126/80 |
| 2,198,535 | 4/1940 | James | 126/314 |
| 3,136,309 | 6/1964 | Martz | 126/314 |
| 4,194,570 | 3/1980 | Arencibia, Jr. | 169/54 |
| 4,341,267 | 7/1982 | Lagasse | 169/51 |
| 4,347,831 | 9/1982 | Graziano | 126/58 |
| 4,434,784 | 3/1984 | Van Patten | 169/54 |

*Primary Examiner*—Samuel Scott
*Assistant Examiner*—Helen Ann Odar
*Attorney, Agent, or Firm*—Pearson & Pearson

[57] ABSTRACT

A fire extinguishing attachment including a bracket for mounting on a stove stack and having a tubular guide therethrough. The tubular guide is an elbow tube having an inner end within the stack directed towards the chimney flue and an outer end outside the stack adapted to receive the nozzle of a powder type fire extinguisher. When a chimney fire occurs, the extinguisher is placed over the outer end of the guide end and activated. The powdered material is directed, by the guide, into the stack and up the chimney to the location of the fire thereby extinguishing the fire. The guide and bracket is preferably downstream of the damper in the same section of stack to be close to the chimney, and for unobstructed flow.

2 Claims, 4 Drawing Figures

FIRE EXTINGUISHING ATTACHMENT FOR CHIMNEY STACKS

BACKGROUND OF THE INVENTION

The present invention relates to fire extinguishing devices for chimneys and more specifically relates to a chimney stack attachment for fire extinguishers. The present invention permits the user of a coal or wood burning stove to extinguish a chimney fire in a simple and quick manner.

Chimney fires have recently been a major source of house fires due to the recent popularity of coal and wood burning stoves. The increased use of wood stoves and fireplaces purchased to combat oil and gas costs has also increased the buildup of flammable products in the chimney, therefore increasing the occurance of chimney fires. Home owners who have converted to wood burning stoves to heat their homes must regularly clean the chimney to avoid the buildup of creosote or soot which has proven to be an expensive and frequently needed procedure. A common method for extinguishing chimney fires from a wood burning stove has been to quickly race to the cellar and throw fire extinguishing powder into the ashpit door. The powder is inhaled up the chimney thereby dousing the fire. This method is obviously unreliable and unsafe.

It would, therefore, be desirable to provide a chimney fire extinguisher to reduce the possibility of damage by and from such fires. In this regard, a number of solutions have been proposed in the art.

One solution has been to provide an apparatus which atomizes liquid as exemplified in Le Gous U.S. Pat. No. 1,889,483. In the event of a chimney fire, the atomizer is placed at the mouth of the fireplace and the liquid is injected up the draught to extinguish the fire. Since wood stoves are attached to chimneys by a chimney stack which leads to the stove belly, liquid injected into a stove belly would probably fail to reach the chimney.

Another solution, shown by Soucy, U.S. Pat. No. 2,297,808 has been to provide a sprinkler system for chimneys. The Soucy assembly incorporates an electrical system which involves a temperature responsive element in the chimney draught which is affected by a high temperature thereby activating a sprinkler system to douse the fire. In this instance, the system is not controlled manually, thus the sprinkler may be activated unintentionally.

Lagasse U.S. Pat. No. 4,341,267 shows a chimney fire extinguisher adapted to be mounted on the top, outside portion of a chimney. The system includes a fluid container suspended outside the chimney having a discharge pipe hanging down inside the chimney. A flow control means is temperature activated thereby releasing the liquid at a certain temperature to douse a chimney fire. Such liquid fire extinguishers tend to be messy after the fire is doused, and may cause chimney cracking.

In U.S. Pat. No. 4,194,570 of Mar. 25, 1980 to Arencibia, Jr. a fire down in a well is extinguished by directing a flow of high momentum, inert gas down a vent against the apex of a conical diffuser and against the flow path of the combustible gas to block the flow, the inert gas preferably being helium.

C. W. Terry, U.S. Pat. No. 3,403,733 discloses an electronic cabinet with fire extinguishing apparatus. This is a built-in system adapted to discharge a fire extinguishing fluid into a closed cabinet without damaging the outside circuitry. The Terry apparatus as a closed system does not appear to be applicable to fireplaces or stoves as is the present invention.

These prior art systems are complicated to use and assemble and are expensive to manufacture. It would appear that there is still a need in the art for a simple and effective device for extinguishing chimney fires.

It is accordingly the object of the present invention to enable the user of a wood burning stove to readily extinguish a chimney fire in a safe, easy and convenient manner. This object is achieved with little apparatus maintenance and with no damage to the chimney.

SUMMARY OF THE INVENTION

The foregoing and related objects are achieved in a fire extinguisher attachment for chimney stacks for use in homes heated by coal or wood burning stoves. Stoves of this type are generally designed with a stack operably connected to the chimney at one end and directed at the opposite end to the belly or burning compartment of the stove.

The present invention includes a bracket or plate mounted by screws onto the stack section closest to the chimney. Welded onto the center of the plate is a hollow tubular guide in the form of a right angle elbow tube. The portion of the tube located within the stack is directed towards the chimney flue while the portion of the tube outside the stack extends radially away from the stack. The tube is, therefore, of generally right angle configuration. The outside portion of the tube is adapted to receive the nozzle of a powder type fire extinguisher which is accessible a safe distance from the stove.

Thus, should the user be alerted to a chimney fire, it is only necessary to reach the extinguisher and attach it to the protruding tube portion and activate the extinguisher. The powdered material will be directed up the chimney flue to the location of the fire. Standard powder extinguishers will eject the material approximately 20 feet with the draught of the chimney, a distance considerably longer than the height of a conventional chimney. The powder extinguishes the fire and exits through the chimney opening.

The chimney stack attachment of the present invention may be easily manufactured with stoves at the factory by providing an opening in the stack for the tubular guide. However, the attachment may be easily assembled on existing stoves by making an opening in the stack and securing the bracket.

Moreover, the present invention is safe to use and does not obstruct the normal chimney draught. The extinguisher should be kept a safe distance from the stove, but within reach. Furthermore, there is no maintenance needed nor any damage caused by the powdered material unlike liquid extinguishers.

The features of the present invention are believed to be novel and are set forth with particularity in the appended claims. The present invention may best be understood by reference to the following description taken in connection with the accompanying drawings.

BRIEF DESCRIPTION OF THE DRAWINGS

These and further features and advantages of the present invention are herein more fully set forth with reference to the accompanying drawings, wherein.

DESCRIPTION OF A PREFERRED EMBODIMENT

Figure 1:
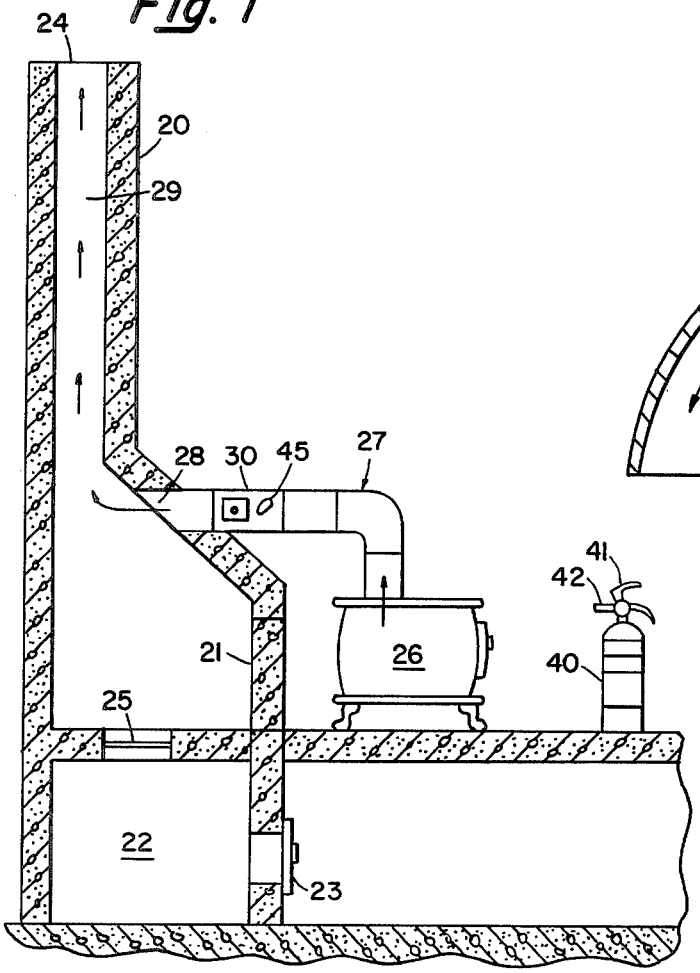
FIG. 1 is a half sectional side elevational view of a typical chimney and fireplace adapted for a wood burning stove, and of a typical powder type fire extinguisher.

Referring now to the drawings and particularly to FIG. 1 thereof, there is illustrated a conventional chimney construction adapted for a wood burning stove 26. The chimney 20 consists of the chimney flue 29, the fireplace 21 (closed off in the drawing), an ashpit 22 located beneath the fireplace 21, an ash deposit door 25 and an ash pit door 23. The wood stove 26 consists of the main body having a stove stack 27 leading to an opening in the chimney at 28. Thus, the room is heated by the stove 26 and the smoke is drawn through stack 27 up and out of the chimney flue 29.

Figure 2:
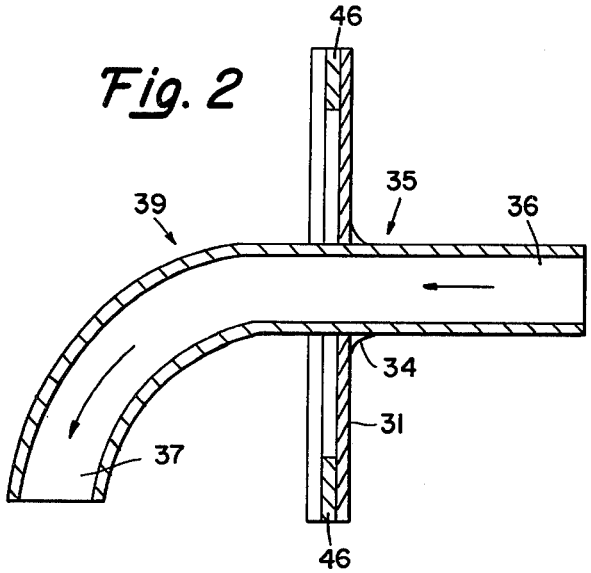
FIG. 2 is an enlarged plan view of the tubular guide and bracket in half section.
Figure 3:
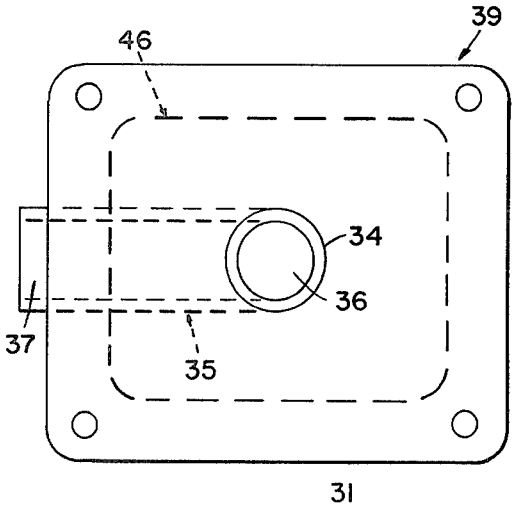
FIG. 3 is a side elevational view on the scale of FIG. 2 of the tubular guide and bracket of the invention.
Figure 4:
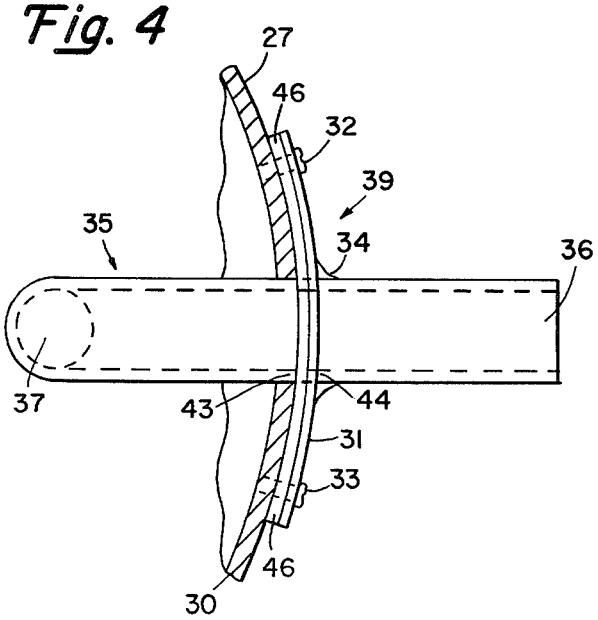
FIG. 4 is an end elevational view, on the scale of FIG. 2 of the tubular guide and bracket of the invention.

The attachment of the present invention, best shown in FIG. 2 and designated at 39, comprises a curved plate 31 having welded therethrough at 34 a tubular guide 35. The tubular guide 35 is of right angle design and has an entrance end 36 and an exit end 37 which extends into stack 27 thereby providing a pathway towards the chimney 20. The bracket 31 may be mounted on the stack 27 by bolts or screws 32 and 33. The entrance end 36 of tubular guide 35 is adapted to slidably receive the nozzle or tube 42 of a powder fire extinguisher 40. Plate 31 preferably includes a peripheral seal 46 therearound to prevent gas leakage.

In accordance with the present invention, the attachment 39 is screwed, or otherwise affixed, to a section 30, of the stack 27 either during manufacture of the stove 26 or onto an existing stove. The powder type fire extinguisher 40, as shown in FIG. 1 has a handle 41 and extinguishing tube 42 and is located in close proximity to the stove. Thus, when the owner is alerted of a chimney fire he needs only to apply tube 42 over the entrance end 36 of the tubular guide 35 and press handle 41 thereby projecting the powdered material in the direction of the arrows. The novel angular design of tubular guide 35 permits the powder, along with the draft of the chimney, to travel up chimney flue 29 in a cloud to the location of the fire. The fire will then be extinguished and the remaining powder exits through the chimney opening 24.

The tubular guide 35 and bracket 31 should be in the stack 27, as close to the chimney 20 as possible for efficiency and when original equipment should be in the stack section containing the damper 45 and downstream therefrom. Thus, when beyond the damper 45, on the chimney side there is no danger of the damper interfering with the cloud of powder injected into, and up the chimney.

The hole 43 in stack section 30 is in registration with the hole 44 in bracket plate 31, when installed, the weld 34 sealing the hole 44.

The present invention has easily solved the problem of extinguishing chimney fires quickly and easily. It is apparent from the foregoing description that the fire extinguishing attachment of the present invention provides numerous advantages over the prior art. The simple construction of the attachments allows adaption to many varying stoves. Furthermore, use of the powdered extinguisher injects up to 20 feet and does not crack or damage the chimneys. Finally, the present invention is uncomplicated and highly effective.

I claim:

1. In combination with a powder fire extinguisher, having a nozzle, and a wood burning stove having a stove stack leading past a damper to a chimney flue:

a fire extinguishing attachment comprising;

a section of a stove stack having a curved side wall with a hole therein;

a curved plate, sealingly covering said hole and affixed on said stack beyond said damper proximate said chimney flue;

a tubular guide of right angular configuration affixed in said curved plate and passing through said hole;

said tubular guide having one end outside said stack for receiving a powdered fire extinguishing material from said nozzle and having the other end extending in the direction of gas flow inside said stack to direct said powder material in the direction of, and up, said chimney, in an unobstructed path without obstructing normal chimney draught.

2. A fire extinguisher attachment for use in a chimney stack leading from a stove past a damper to a chimney in conjunction with a powder type fire extinguisher said attachment comprising:

a section of said stack having a side wall with a hole therein;

a plate of arcuately curved configuration, shaped to fit closely over the outside face of said side wall of said stack section beyond said damper and having a hole therethrough adapted to register with the hole in said side wall;

and a hollow tube, of substantially right angular configuration, having one end projecting from said plate, and extending outside said stack, thence extending through said registering holes in said plate and wall, to the other end, angularly disposed within said stack to extend in the direction of unobstructed flow of combustion gases toward said chimney;

whereby the nozzle of said extinguisher may be applied to said one end for delivering a cloud of powder from said other end up said chimney to extinguish a fire therein without adversely affecting said stove and without obstructing normal chimney draught.

* * * * *